United States Patent [19]

Imai et al.

[11] 4,337,062

[45] Jun. 29, 1982

[54] ANTI-MIGRATION AGENT FOR DYEING

[75] Inventors: Hirosuke Imai; Teruaki Yamanashi; Hiroyuki Itoh, all of Yokohama, Japan

[73] Assignee: Nippon Oil Company, Ltd., Tokyo, Japan

[21] Appl. No.: 208,496

[22] Filed: Nov. 20, 1980

Related U.S. Application Data

[63] Continuation of Ser. No. 73,328, Sep. 7, 1979, abandoned.

[51] Int. Cl.[3] ..... D06P 1/52; D06P 1/16; D06P 1/41

[52] U.S. Cl. ..... 8/557; 525/369; 525/378

[58] Field of Search ..... 525/369, 378; 8/557

[56] References Cited

U.S. PATENT DOCUMENTS

| | | | |
|---|---|---|---|
| 3,891,386 | 6/1975 | Reid et al. | 8/557 |
| 3,940,247 | 2/1976 | Sthave et al. | 8/557 |
| 3,957,427 | 5/1976 | Chambers | 8/557 |
| 4,036,587 | 7/1977 | Wolf et al. | 8/557 |
| 4,181,498 | 1/1980 | Koltai et al. | 8/557 |
| 4,264,324 | 4/1981 | Chavannes et al. | 8/557 |

FOREIGN PATENT DOCUMENTS

| | | | |
|---|---|---|---|
| 1904309 | 10/1970 | Fed. Rep. of Germany | 8/557 |
| 2031469 | 4/1980 | Fed. Rep. of Germany | 8/557 |

*Primary Examiner*—William F. Hamrock

*Attorney, Agent, or Firm*—Scully, Scott, Murphy and Presser

[57] ABSTRACT

According to this invention, there is provided an anti-migration agent for dyeing comprising a water-soluble, neutral polymer salt of a polymer anion and at least one cation, said polymer anion being a copolymer or a partially esterified matter thereof, said copolymer consisting of at least one monomer selected from the group consisting of $C_4$ of $C_7$ conjugated diene and isobutylene and at least one member selected from the group consisting of maleic acid, maleic anhydride and derivatives thereof, and said cation being selected from the group consisting of $Na^+$, $K^+$, $Li^+$ and ammonium ions represented by the general formula $R_1R_2R_3R_4N^+$ wherein $R_1$, $R_2$, $R_3$ and $R_4$ are selected from the group consisting of hydrogen, $C_1$ to $C_6$ alkyl, cycloalkyl and phenyl.

3 Claims, 2 Drawing Figures

ANTI-MIGRATION AGENT FOR DYEING

This is a continuation of application Ser. No. 073,328, filed Sept. 7, 1979 now abandoned.

BACKGROUND OF THE INVENTION

1. Field of the Invention

This invention relates to a dyeing assistant and more particularly to an anti-migration agent for preventing the migration of a dye applied to a cloth to be dyed.

2. Description of the Prior Art

In dyeing a hydrophobic synthetic fiber, sometimes a dye undergoes migration making a uniform dyeing difficult in the drying process after applying a dyeing solution to the fiber cloth. For example, in the thermosol dyeing wherein a polyester cloth is padded with a disperse dye, then dried and thereafter subjected to a dry heat treatment at a high temperature, it is necessary that the drying after padding should be a uniform drying, and even if a uniform drying is applied, there is a problem such that the disperse dye undergoes migration resulting in occurrence of an uneven dyeing. To remedy such a defective dyeing resulting from migration of a dye, there has been adopted the addition of a viscosity intensifier such as sodium alginate. But sodium alginate is expensive and its effect is not yet fully satisfactory.

Also, in dyeing a cellulosic cloth, e.g. cotton and hemp, a uniformly applied dyeing solution sometimes undergoes migration in the drying process. For example, in dyeing a cellulosic cloth with a reactive dye according to the pad dry cure method, there occurs migration of a dye based on uneven drying in the drying process resulting in occurrence of an uneven dyeing. Also in the dyeing according to the vat steam process using a vat dye, the migration of a dye in the drying process causes a defective dyeing. And to prevent such a migration, there has been used sodium alginate.

Thus, the dyeing industry has been harassed by the problem that in the drying process for fixing a dye to a cloth, the dye which has been uniformly applied to the cloth in the preceding stage undergoes migration and is fixed unevenly to the cloth resulting in an uneven dyeing. Therefore, the development of an effective anti-migration agent has been desired.

SUMMARY OF THE INVENTION

Having made a comprehensive study about the method of preventing such a migration of a dye, we at last reached the present invention. The new anti-migration agent of this invention is characteristic in that not only the migration of a dye applied to a cloth can be prevented in the drying process thereby preventing the occurrence of an uneven dyeing, but also the anti-migration agent in question can be removed easily after use. It is further characteristic in that COD and BOD in waste water can be lowered.

The anti-migration agent of this invention is a neutral alkali metal salt or a neutral ammonium or amine salt of a copolymer or a partially esterified matter thereof, which copolymer consists of at least one monomer selected from the group consisting of a conjugated diene and isobutylene and at least one member selected from the group consisting of maleic acid, maleic anhydride and derivatives thereof. More particularly, the anti-migration agent of this invention is a water-soluble, neutral polymer salt of a polymer anion and at least one cation, said polymer anion being a copolymer or a partially esterified matter thereof, said copolymer consisting of at least one monomer selected from the group consisting of $C_4$ to $C_7$ conjugated diene and isobutylene and at least one member selected from the group consisting of maleic acid, maleic anhydride and derivatives thereof, and said cation being selected from the group consisting of $Na^+$, $K^+$, $Li^+$ and ammonium ions represented by the general formula $R_1R_2R_3R_4N^+$ wherein $R_1$, $R_2$, $R_3$ and $R_4$ are selected from the group consisting of hydrogen, $C_1$ to $C_6$ alkyl, cycloalkyl and phenyl.

BRIEF DESCRIPTION OF THE DRAWING

In FIGS. 1 and 2, the reference numeral 1 is a test cloth, 2 is a glass plate, 3 is a slide glass, 4 is a 50 g. weight, 5 and 6 are creases of the test cloth.

DESCRIPTION OF THE INVENTION

Figure 1:
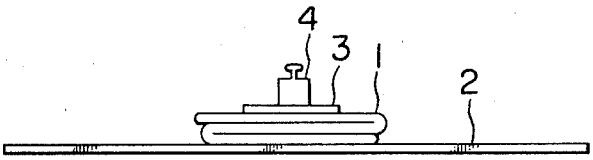
FIG. 1 is a side view of an anti-migration experiment for determining the effect of the anti-migration agent for dyeing of this invention.

The copolymer as a raw material of the anti-migration agent of this invention is an alternate copolymer consisting of conjugated diene or isobutylene units and maleic acid, maleic anhydride or derivative thereof units, which are copolymerized in a generally known manner. Such a copolymer can be prepared for example in the following manner. A conjugated diene and/or isobutylene and at least one member selected from the group consisting of maleic acid, maleic anhydride and derivatives thereof are copolymerized by a known method (e.g. using a radical initiator). Furthermore, a copolymer of a conjugated diene and/or isobutylene and at least one member selected from the group consisting of maleic acid, maleic anhydride and derivatives thereof may be partially esterified with alcohol for use as a starting copolymer of the anti-migration agent of this invention.

The partial esterification referred to herein means reacting part of the acid radical which the aforesaid copolymer possesses with a hydroxyl-containing compound of $C_1$ to $C_{20}$. Conjugated dienes which may be used in this invention are those having 4 to 7 carbon atoms, for example, butadiene, isoprene, chloroprene, 2,3-dimethylbutadiene, piperylene, 2,3-dichlorobutadiene, 2-methyl-1,3-hexadiene, and 1-methoxy-1,3-butadiene, among which butadiene, isoprene and piperylene are specially preferred. Examples of maleic anhydride and derivatives thereof employable in this invention are maleic anhydride, methylmaleic anhydride, monochloromaleic anhydride, and dichloromaleic anhydride, especially maleic anhydride is preferred. Furthermore, to illustrate maleic acid and derivatives thereof which may be used in this invention, mention may be made of maleic acid, fumaric acid, methylmaleic acid, maleic acid monoester, maleic acid diester, monochloromaleic acid, and dichloromaleic acid, among which maleic acid, maleic acid mono- and diesters are preferred. The ester groups referred to herein indicate esters of $C_1$ to $C_{20}$ alkyl and cycloalkyl groups, such as methyl, ethyl, propyl, butyl, pentyl, hexyl, heptyl and octyl.

The anti-migration agent of this invention is prepared, as previously explained, from a copolymer of a conjugated diene and/or isobutylene and at least one member selected from the group consisting of maleic acid, maleic anhydride, and derivatives thereof. But if the starting copolymer is low in molecular weight, the anti-migration ability becomes low, so the molecular weight of the starting copolymer should be in the range of preferably from 0.4 to 5.0 and more preferably from 0.5 to 4.0 in terms of an intrinsic viscosity measured in cyclohexanone at 30° C. after converting the maleic acid or derivative thereof units in the copolymer into maleic adhydride or derivative thereof units chemically or by a thermal treatment.

In preparing the anti-migration agent of this invention from the foregoing copolymers, for example in case a copolymer of a conjugated diene and/or isobutylene and a maleic anhydride or derivative thereof is to be used, an aqueous solution of oxide, hydroxide, carbonate or bicarbonate of an alkali metal such as lithium, sodium or potassium, or an aqueous solution of ammonia or an amine represented by the general formula $R_1R_2R_3N$ wherein $R_1$, $R_2$ and $R_3$ are selected from the group consisting of hydrogen, $C_1$ to $C_6$ alkyl, cycloalkyl and phenyl, is added in an amount from 1.2 to 1.6 mols, preferably from 1.3 to 1.5 mols (as a cation of metal or ammonium ion) per mol of the maleic anhydride or derivative thereof units in the copolymer to allow the copolymer to be dissolved therein while adjusting the pH of the solution to between 6 and 8, preferably between 6.5 and 7.5. The amount of an alkali metal compound, ammonia or amine required to neutralize the copolymer varies according to the kind of copolymer, so it should be changed as necessary. But what is important is to prepare a neutral polymer salt, whereby there is obtained an aqueous solution in which is ionized the said neutral salt.

Also in the case of using a copolymer of a conjugated diene and/or isobutylene and a maleic acid or derivative thereof, a neutral salt thereof can be prepared in the same manner as in the case of the aforesaid copolymer of maleic anhydride or derivative thereof. But when the maleic acid derivative thereof unit is a maleic acid ester unit, that is, when a maleic acid ester is used as a maleic acid derivative, or when the copolymer is partially esterified, the amount of an alkali metal compound, ammonia or amine to be added decreases accordingly. Furthermore, when the maleic acid derivative unit is a maleic acid diester unit, it is necessary that the diester groups should be partially hydrolyzed with the added alkali metal compound, ammoni or amine as catalyst; otherwise, a water-soluble polymer salt is not formed. To form a water-soluble polymer salt which is very effective for the prevention of migration, the amount of ester groups in the polymer salt should be not larger than 1.5 mols, preferably not larger than 1.0 mol, per mol of the maleic acid derivative units in the polymer.

An aqueous solution of the neutral polymer salt thus obtained may be used as it is as an anti-migration agent. It may also be concentrated or dried up for convenience in preservation or transport.

The anti-migration agent of this invention is employable in the dip dyeing and printing for both hydrophobic and hydrophilic fibers, and it exhibits an outstanding effect particularly when used in the thermosol dyeing for a polyester cloth using a disperse dye, in the pad dry cure process dyeing for a cellulosic cloth (e.g. cotton, hemp) using a reactive dye, and in the vat steam process dyeing using a vat dye. In using the anti-migration agent of this invention, various additives may be added unless they badly affect dyeing, for example, a neutral salt of an alkali metal such as sodium alginate or common salt.

The amount of the anti-migration agent of this invention to be used varies according to the kind of cloth to be dyed, the kind of dye and the dyeing method, but it is in the range of from 0.05% to 10%, preferably from 0.1% to 5%, of the dyeing solution in terms of the total weight of the neutral polymer salt.

DESCRIPTION OF PREFERRED EMBODIMENTS

Working examples of this invention are given below to further illustrate the anti-migration agent of the invention.

EXAMPLES 1-4 AND COMPARATIVE EXAMPLE 1

15.2 g. of an alternate butadiene-maleic anhydride copolymer (with an intrinsic viscosity in cyclohexanone solution at 30° C. of 1.20) which had been prepared using azoisobutyronitrile as catalyst and acetone as polymerization solvent, was placed in a 300 ml separable flask, then 150 ml of an aqueous 1 N caustic soda solution was added, followed by stirring thoroughly to allow dissolution to take place. The resulting polymer solution, with a pH of 7, was used as sample I.

Next, 0.5 g. of C. I. Bayen Resolin Yellow RL, 0.5 g. of C. I. Sumikaron Red E-FBL, 0.5 g. of C. I. Sumikaron Blue E-FBL and a predetermined amount of sample I were mixed together and then diluted with water to a total weight of 100 g. as a dyeing solution. In this dyeing solution were dipped for 1 minute two sheets, one over the other, of a finished yarn fabric of 100% Tetoron (10×15 cm). The two-ply test cloth was squeezed with rollers up to a weight increase of about 100% and then dried for 2 minutes at 120° C. The dried cloth was treated for 1 minute at 180° C., then subjected to reduction cleaning, water-washing and drying. To check the anti-migration effect, the difference in concentration between the surface and the back of the dyed, two-ply test cloth was evaluated by a visual test, the results of which are shown in Table I, in which table were also shown for reference the results of test without using the anti-migration agent.

Since this migration test is adjusted so that an extremely uneven drying will occur in the drying process for the test cloth, migration is very liable to occur as compared with ordinary dyeing conditions.

TABLE I

| | Anti-migration effect in the dyeing of a finished Tetoron yarn fabric | | |
|---|---|---|---|
| Experiment No. | Kind of anti migration agent | Amount of anti-migration agent (g) | Anti-migration effect (e) |
| Example 1 | Sample I | 1.1 (a) | Δ ~ O |
| Example 2 | " | 2.2 (b) | O |
| Example 3 | " | 3.3 (c) | O |
| Example 4 | " | 4.0 (d) | O |
| Comparative Example 1 | None | 0 | X |

(a) about 0.1 g. as the content of butadiene-maleic acid copolymer
(b) about 0.2 g. as the content of butadiene-maleic acid copolymer
(c) about 0.3 g. as the content of butadiene-maleic acid copolymer
(d) about 0.4 g. as the content of butadiene-maleic acid copolymer
(e) Evaluated on the following basis:
O Concentration difference not recognized
Δ Concentration difference recognized a little
X Concentration difference noticeable Reference to Table 1 shows that migration and uneven dyeing are noticeable in the absence of the anti-migration agent. The sample I anti-migration agent, when added only 0.1 g. as polymer, can suppress migration and, with 0.2 g. added, it prevents migration almost completely.

EXAMPLES 5-8

15.4 g. of an alternate isobutene-maleic anhydride copolymer (with an intrinsic viscosity in cyclohexanone at 30° C. of 1.12) which had been prepared using azoisobutyronitrile as catalyst and benzene as polymerization solvent, was placed in a 300 ml separable flask, then 120 ml of an aqueous 1 N caustic soda solution was added, followed by stirring to allow dissolution to take place. The resulting polymer solution, with a pH of 7, was used as sample II.

Next, 0.5 g. of C. I. Bayen Resolin Yellow RL, 0.5 g. of C. I. Sumikaron Red E-FBL, 0.5 g. of C. I. Sumikaron Blue E-FBL and a predetermined amount of sample II were mixed together and then diluted with water to a total weight of 100 g. as a dyeing solution. In this dyeing solution were dipped for 1 minute two sheets, one over the other, of a finished yarn fabric of 100% Tetoron (10×15 cm). The two-ply test cloth was squeezed with rollers up to a weight increase of about 100% and then dried for 2 minutes at 120° C. The dried cloth was treated for 1 minute at 180° C., then subjected to reduction cleaning, water-washing and drying. To check the anti-migration effect, the difference in concentration between the surface and the back of the dyed, two-ply test cloth was evaluated by a visual test, the results of which are shown in Table II.

TABLE II

| Experiment No. | Anti-migration effect in the dyeing of a finished Tetoron yarn fabric: Kind of anti-migration agent | Amount of anti-migration agent (g) | Anti-migration effect (e) |
|---|---|---|---|
| Example 5 | Sample II | 0.9 (a) | Δ ~ ○ |
| Example 6 | " | 1.8 (b) | ○ |
| Example 7 | " | 2.6 (c) | ○ |
| Example 8 | " | 3.5 (d) | ○ |

(a) about 0.1 g. as the content of isobutene-maleic acid copolymer
(b) about 0.2 g. as the content of isobutene-maleic acid copolymer
(c) about 0.3 g. as the content of isobutene-maleic acid copolymer
(d) about 0.4 g. as the content of isobutene-maleic acid copolymer
(e) The evaluation method was the same as in Example 1.

Reference to Table II shows that the sample II anti-migration agent when added only 0.1 g. as polymer, can suppress migration and, with 0.2 g. added, it prevents migration almost completely. Thus, the sample II clearly shows an anti-migration effect in the dyeing of a finished Tetoron yarn fabric with disperse dyes.

EXAMPLES 9-11 AND COMPARATIVE EXAMPLES 2-5

Figure 2:
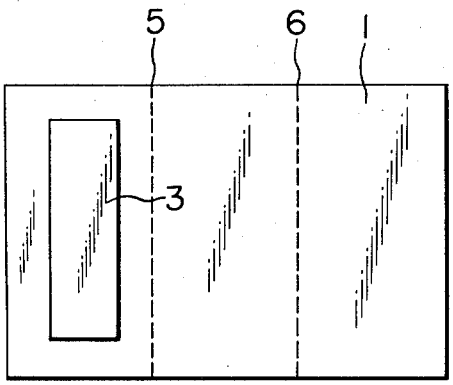
FIG. 2 is a development of a test cloth used in the said experiment.

0.5 g. of C. I. Bayen Resolin Yellow RL, 0.5 g. of C. I. Sumikaron Red E-FBL, 0.5 g. of C. I. Sumikaron Blue E-FBL and a predetermined amount of the sample I used in Example 1 or sodium alginate were mixed together and then diluted with water to a total weight of 100 g. as a dyeing solution. In this dyeing solution was dipped for 1 minute a jersey cloth of 100% Tetoron (10×15 cm). Then, according to the Honma et al.'s method (see "Kyozome and Scouring," 24, 50, 1973), as illustrated in FIG. 1 (a side view of an anti-migration experiment) and FIG. 2 (a development of the test cloth), the test cloth (1) was folded in three and put on a glass plate (2), then on the central portion thereof were put a slide glass (3) and a 50 g. weight (4). In this condition, the dyes were allowed to be adsorbed in the cloth for 30 minutes in a dryer at 150° C. The test cloth was then subjected to reduction cleaning, water-washing and drying. To check the anti-migration effect, the difference in concentration between the portion of the dried, dyed test cloth just under the slide glass plate and the other portion was evaluated by a visual test, the results of which are shown in Table III. In FIG. 2, the reference numeral (1) is a test cloth 10 cm long×15 cm wide, (3) is a slide glass 7.5 cm long by 2.5 cm wide, (5) and (6) are creases of the test cloth.

Since this migration test is adjusted so that an extremely uneven drying will occur in the drying process for the test cloth, migration is very liable to occur as compared with ordinary dyeing conditions.

TABLE III

| Experiment No. | Anti-migration effect in the dyeing of Tetoron jersey cloth: Kind of anti-migration agent | Amount of anti-migration agent (g) | Anti-migration effect (d) |
|---|---|---|---|
| Example 9 | Sample I | 1.1 (a) | Δ ~ ○ |
| Example 10 | " | 2.2 (b) | ○ |
| Example 11 | " | 3.3 (c) | ○ |
| Comparative Example 2 | None | 0 | X |
| Comparative Example 3 | Sodium alginate | 0.1 | Δ |
| Example 4 | " | 0.2 | ○ |
| Example 5 | " | 0.3 | ○ |

(a) about 0.1 g. as the content of butadiene-maleic acid copolymer
(b) about 0.2 g. as the content of butadiene-maleic acid copolymer
(c) about 0.3 g. as the content of butadiene-maleic acid copolymer
(d) Evaluated on the following basis:
Concentration difference not recognized
Δ Concentration difference recognized a little
X Concentration difference noticeable Reference to Table III clearly shows that the anti-migration effect according to this invention is remarkable.

EXAMPLES 12-14

30.4 g. of an alternate butadiene-maleic anhydride copolymer (with an intrinsic viscosity in cyclohexanone solution at 30° C. of 0.90) which had been prepared using azoisobutyronitrile as catalyst and cyclohexanone as polymerization solvent, was placed in a 500 ml flask, then 400 ml of methanol was added, and the mixture was boiled to reflux to allow dissolution to take place. The methanol solution thus obtained was dropwise added into a large amount of water to allow polymer to precipitate. The precipitated polymer was withdrawn and dried under reduced pressure leaving about 36.5 g. of polymer, which, from estimation of carboxylic acid groups therein, was identified to be a monomethylester of the butadiene-maleic acid copolymer. Then, 18.9 g. of the said monomethylester of the butadiene-maleic acid copolymer was placed in a 300 ml separable flask, followed by adding 100 ml of an aqueous 1 N caustic soda solution and stirring thoroughly to allow dissolution to take place. The resulting polymer solution, with a pH of 7, was used as sample III.

Next, 0.5 g. of C. I. Bayen Resolin Yellow RL, 0.5 g. of C. I. Sumikaron Red E-FBL, 0.5 g. of C. I. Sumikaron Blue E-FBL and a predetermined amount of sample III were mixed together and diluted with water to a total weight of 100 g. as a dyeing solution. Then, a migration test in the dyeing of a finished yarn fabric of 100% Tetoron was conducted according to Example 1, the results of which are shown in Table IV.

TABLE IV

| Experiment No. | Anti-migration effect in the dyeing of a finished Tetoron yarn fabric: Kind of anti-migration agent | Amount of anti-migration agent (g) | Anti-migration effect (e) |
|---|---|---|---|
| Example 12 | Sample III | 0.63 (a) | Δ ~ ○ |
| Example 13 | " | 1.26 (b) | ○ |
| Example 14 | " | 1.89 (c) | ○ |

(a) 0.1 g. as the content of monomethylester of butadiene-maleic acid copolymer
(b) 0.2 g. as the content of monomethylester of butadiene-maleic acid copolymer
(c) 0.3 g. as the content of monomethylester of butadiene-maleic acid copolymer
(d) The evaluation method was the same as in Example 1.

Reference to Table III clearly shows that the anti-migration effect of sample III is remarkable.

EXAMPLES 15-17 AND COMPARATIVE EXAMPLES 6-9

15.2 g. of an alternate butadiene-maleic anhydride copolymer (with an intrinsic viscosity in cyclohexanone solution at 30° C. of 0.61) which had been prepared using azoisobutyronitrile as catalyst and cyclohexanone as polymerization solvent, was placed in a 300 ml separable flask, then 150 ml of 1 N caustic soda was added, followed by stirring to allow dissolution to take place. The resulting polymer solution, with a pH of 7, was used as sample IV.

Then, 0.1 g. of C. I. Direct Red B and a predetermined amount of sample IV were mixed together and diluted with water to a total weight of 100 g. as a dyeing solution. This dyeing solution was heated to 80° C., in which was then dipped for 1 minute a broadcloth of 100% cotton as test cloth (10×15 cm). The test cloth was then squeezed with rollers up to a weight increase of about 150%, then, in the same manner as in Example 9, it was folded in three and put on a glass plate, thereafter on the central portion thereof were put a slide glass and a 50 g. weight. In this condition, the dye was allowed to be adsorbed in the cloth for 30 minutes at 120° C. Subsequent water-washing and air-drying of the test cloth afforded the results shown in Table V, in which table were also shown for reference the results of test without using the anti-migration agent and with sodium alginate added as an anti-migration agent.

TABLE V

| Experiment No. | Anti-migration effect in cotton dyeing: Kind of anti-migration agent | Amount of anti-migration agent (g) | Anti-migration effect (d) |
|---|---|---|---|
| Example 15 | Sample IV | 0.78 (a) | Δ ~ ○ |
| Example 16 | " | 3.91 (b) | ○ |
| Example 17 | " | 7.81 (c) | ○ |
| Comparative Example 6 | None | 0 | X |
| Comparative Example 7 | Sodium alginate | 0.1 | X |
| Example 8 | " | 0.5 | X |
| Example 9 | " | 1.0 | Δ |

(a) Solid content 0.1 g.
(b) Solid content 0.5 g.
(c) Solid content 1.0 g.
(d) The evaluation method was the same as in Example 9.

Reference to Table V clearly shows that migration and uneven dyeing are noticeable in the absence of the anti-migration agent, and that in the case of sodium alginate which is often used as an anti-migration agent, small amounts of its addition cause a violent migration and only after its addition as much as 1 g. migration is mitigated. On the other hand, the sample IV anti-migration agent, when added only 0.1 g. as polymer, suppressed migration and, with 0.5 g. added, it prevented migration almost completely. Also from this fact it is apparent that the anti-migration effect according to this invention is remarkable.

EXAMPLES 18-20

15.4 g. of an alternate isobutene-maleic anhydride copolymer (with an intrinsic viscosity in cyclohexanone solution at 30° C. of 0.98) which had been prepared using azoisobutyronitrile as catalyst and benzene as polymerization solvent, was placed in a 300 ml separable flask, then 120 ml of an aqueous 1 N caustic soda solution was added, followed by stirring to allow dissolution to take place. The resulting polymer solution, with a pH of 7, was used as sample V.

Then, 0.1 g. of C. I. Direct Red B and a predetermined amount of sample V were mixed together and diluted with water to a total weight of 100 g. as a dyeing solution. Thereafter, a migration test in the dyeing of a 100% cotton broadcloth was conducted in the same manner as in Example 15, the results of which are shown in Table VI.

TABLE VI

| Experiment No. | Anti-migration effect in cotton dyeing: Kind of anti-migration agent | Amount of anti-migration agent (g) | Anti-migration effect (d) |
|---|---|---|---|
| Example 18 | Sample V | 0.67 (a) | Δ ~ ○ |
| Example 19 | " | 3.36 (b) | ○ |
| Example 20 | " | 6.71 (c) | ○ |

(a) Solid content 0.1 g.
(b) Solid content 0.5 g.
(c) Solid content 1.0 g.
(d) The evaluation method was the same as in Example 9.

Thus, sample V clearly shows an anti-migration effect in cotton dyeing.

EXAMPLES 21-23 AND COMPARATIVE EXAMPLES 10-13

15.2 g. of an alternate butadiene-maleic anhydride copolymer (with an intrinsic viscosity in cyclohexanone solution at 30° C. of 0.86) which had been prepared using azoisobutyronitrile as catalyst and cyclohexanone as polymerization solvent, was dissolved in 150 ml of an aqueous 1 N caustic potash solution in a 300 ml separable flask. The resulting polymer solution, with a pH of 7, was used as sample VI.

Then, 1.5 g. of C. I. Disperse Orange 13 and a predetermined amount of sample VI or sodium alginate were mixed together and diluted with water to a total weight of 100 g. as a dyeing solution. In this dyeing solution were dipped for 1 minute two sheets, one over the other, of a blended broadcloth (10×15 cm) consisting of 65% Tetoron and 35% cotton. This two-ply test cloth was squeezed with rollers up to a weight increase of about 60% and then the dye was allowed to be adsorbed in the cloth for 1 hour in a dryer at 120° C. The test cloth was then washed with water and dried. The anti-migration effect was evaluated from the difference in concentration between the surface and the back of the dyed test cloth in the same manner as in Example 1, the results of which are shown in Table VII.

TABLE VII

| Experiment No. | Anti-migration effect in dyeing of a blended Tetoron-cotton cloth: Kind of anti-migration agent | Amount of anti-migration agent (g) | Anti-migration effect (d) |
|---|---|---|---|
| Example 21 | Sample VI | 0.70 (a) | Δ ~ ○ |
| Example 22 | " | 1.41 (b) | ○ |
| Example 23 | " | 2.11 (c) | ○ |
| Comparative Example 10 | None | 0 | X |
| Comparative Example 11 | Sodium alginate | 0.1 | Δ |
| Example 12 | " | 0.2 | ○ |
| Example 13 | " | 0.3 | ○ |

(a) Solid content 0.1 g.
(b) Solid content 0.2 g.
(c) Solid content 0.3 g.
(d) The evaluation method was the same as in Example 1.

From the above table it is apparent that the anti-migration agent of this invention exhibits an anti-migration effect in the dyeing of a blended Tetoron-cotton cloth with a disperse dye.

EXAMPLES 24–26

16.6 g. of an alternate isoprene-maleic anhydride copolymer (with an intrinsic viscosity in cyclohexanone solution at 30° C. of 0.77) which had been prepared using azoisobutyronitrile as catalyst and cyclohexanone as polymerization solvent, was dissolved in 150 ml of an aqueous 1 N caustic soda solution in a 300 ml separable flask. The resulting polymer solution, with a pH of 7, was used as sample VII.

Then, 0.5 g. of C. I. Bayen Resolin Yellow, 0.5 g. of C. I. Sumikaron Red E-FBL, 0.5 g. of C. I. Sumikaron Blue E-FBL and a predetermined amount of sample VII were mixed together and diluted with water to a total weight of 100 g. as a dyeing solution. Thereafter, a migration test in the dyeing of a finished yarn fabric of 100% Tetoron was conducted in the same manner as in Example 1, the results of which are shown in Table VIII.

TABLE VIII

| Experiment No. | Anti-migration effect in the dyeing of a finished Tetoron yarn fabric: Kind of anti-migration agent | Amount of anti-migration agent (g) | Anti-migration effect (d) |
|---|---|---|---|
| Example 24 | Sample VII | 0.74 (a) | Δ |
| Example 25 | " | 1.47 (b) | ○ |
| Example 26 | " | 2.21 (c) | ○ |

(a) Solid content 0.1 g.
(b) Solid content 0.2 g.
(c) Solid content 0.3 g.
(d) The evaluation method was the same as in Example 1.

EXAMPLES 27–30

50 g. of sample I used in Example 1 was dried in a rotary evaporator and further dried under reduced pressure to give 6.41 g. of a solid sample.

Then, 1.5 g. of C. I. Disperse Yellow 42 and a predetermined amount of a solid powder of sample I were mixed together and diluted with water to a total weight of 100 g. as a dyeing solution. In this dyeing solution was dipped for 1 minute a 100% Tetoron broadcloth (10×15 cm), then this test was squeezed with rollers up to a weight increase of about 80% and thereafter dried for 5 minutes at 120° C. The dried test cloth was treated at 200° C. for 1 minute, then subjected to reduction cleaning, water-washing and air-drying. The results are shown in Table IX. The anti-migration effect was evaluated from the degree of uneven dyeing of the dyed cloth.

TABLE IX

| Experiment No. | Anti-migration effect in Tetoron broadcloth dyeing: Kind of anti-migration agent | Amount of anti-migration agent (g) | Anti-migration effect (a) |
|---|---|---|---|
| Example 27 | Sample I | 0.1 | Δ |
| Example 28 | " | 0.2 | ○ |
| Example 29 | " | 0.3 | ○ |

(a) Evaluated on the following basis:
No uneven dyeing throughout the test cloth
Δ Slight uneven dyeing in the test cloth
X Noticeable uneven dyeing in the test cloth

EXAMPLES 30–32

15.2 g. of an alternate butadiene-maleic anhydride copolymer (with an intrinsic viscosity in cyclohexanone solution at 30° C. of 1.45) which had been prepared using azoisobutyronitrile as catalyst and acetone as polymerization solvent, was dissolved in 150 ml of an aqueous 1 N ammonia solution in a 300 ml separable flask. The resulting polymer solution, with a pH of 7, was used as sample VIII.

Then, 1 g. of C. I. Reactive Yellow 3, 3 g. of urea, 1 g. of sodium carbonate and a predetermined amount of sample VIII were mixed together and diluted with water to a total weight of 100 g. as a dyeing solution. In this dyeing solution was dipped for 1 minute a 100% cotton broadcloth (10×15 cm), which was then squeezed with rollers up to a weight increase of about 200%. Thereafter, in the same manner as in Example 9, this test cloth was folded in three and put on a glass plate, then on the central portion thereof were placed a slide glass and a 50 g. weight. In this condition the test cloth was heat-treated at 110° C. for 20 minutes, then it was washed with water and air-dried. The results are shown in Table X.

TABLE X

| Experiment No. | Anti-migration effect in cotton dyeing: Kind of anti-migration agent | Amount of anti-migration agent (g) | Anti-migration effect (d) |
|---|---|---|---|
| Example 30 | Sample VIII | 0.78 (a) | Δ |
| Example 31 | " | 3.90 (b) | ○ |
| Example 32 | " | 7.79 (c) | ○ |

(a) Solid content 0.1 g.
(b) Solid content 0.5 g.
(c) Solid content 1.0 g.
(d) The evaluation method was the same as in Example 9.

We claim:

1. In a process for dyeing employing an anti-migration agent, the improvement which comprises employing as the anti-migration agent a water-soluble, neutral polymer salt of a polymer anion and at least one cation, said polymer anion being an alternate copolymer or a partial esterificate thereof, said copolymer consisting of at least one monomer selected from the group consisting of $C_4$ to $C_7$ conjugated diene and isobutylene and at least one member selected from the group consisting of maleic acid, maleic anhydride and derivatives thereof, and having an intrinsic viscosity measured in cyclohexanone at 30° C. of from 0.4 to 5.0 and said cation being selected from the group consisting of $Na^+$, $K^+$, $Li^+$ and ammonium ions represented by the general formula $R_1R_2R_3R_4N^+$ wherein $R_1$, $R_2$, $R_3$ and $R_4$ are selected from the group consisting of hydrogen, $C_1$ to $C_6$ alkyl, cycloalkyl and phenyl.

2. The anti-migration agent for dyeing as defined in claim 1, in which said water-soluble, neutral polymer salt is obtained by neutralizing said copolymer in an aqueous solution with 1.2 to 1.6 mols (as a cation of metal or ammonium ion) per mol of the maleic acid, maleic anhydride or derivative thereof units in said copolymer of a hydroxide, oxide, carbonate or bicarbonate of a metal selected from Na, K and Li, or an amine represented by the general formula $R_1R_2R_3N$ wherein $R_1$, $R_2$ and $R_3$ are as defined in claim 1.

3. The anti-migration agent for dyeing as defined in claim 1, in which said copolymer consists of butadiene and maleic anhydride.

* * * * *

UNITED STATES PATENT AND TRADEMARK OFFICE

CERTIFICATE OF CORRECTION

PATENT NO. : 4,337,062

DATED : June 29, 1982

INVENTOR(S) : Hirosuke Imai, et al.

It is certified that error appears in the above-identified patent and that said Letters Patent are hereby corrected as shown below:

Column 9, line 66: "this test was" should read as --this test cloth was--.

Column 10, line 13 (under Table IX): before "No uneven dyeing throughout the test cloth" insert --◯--.

Signed and Sealed this

*Twenty-first* Day of *September 1982*

[SEAL]

*Attest:*

GERALD J. MOSSINGHOFF

*Attesting Officer*

*Commissioner of Patents and Trademarks*